US005850922A

United States Patent [19]

Fraser

[11] Patent Number: 5,850,922

[45] Date of Patent: Dec. 22, 1998

[54] SHIPPING AND RETAIL DISPLAY PALLET PACK

[75] Inventor: Ronald A. Fraser, Chandler, Ariz.

[73] Assignee: Ryobi North America, Inc., Easley, S.C.

[21] Appl. No.: 649,206

[22] Filed: May 17, 1996

[51] Int. Cl.[6] ..... B65D 85/20

[52] U.S. Cl. ..... 206/736; 206/349; 206/386; 206/443; 211/70.6

[58] Field of Search ..... 206/319, 320, 206/349, 372, 443, 526, 597, 600, 736; 211/60.1, 70.1, 70.6

[56] References Cited

U.S. PATENT DOCUMENTS

| | | | |
|---|---|---|---|
| 2,291,645 | 8/1942 | Nordquist . | |
| 2,594,287 | 4/1952 | Budd | 206/597 |
| 2,727,620 | 12/1955 | Buttery . | |
| 3,481,453 | 12/1969 | Shreve, III et al. . | |
| 3,669,253 | 6/1972 | Hanko . | |
| 3,741,380 | 6/1973 | Carney . | |
| 3,747,831 | 7/1973 | Hanson . | |
| 3,747,835 | 7/1973 | Graser . | |
| 3,874,500 | 4/1975 | Nicholl . | |
| 4,171,050 | 10/1979 | Murray et al. . | |
| 4,247,003 | 1/1981 | Jones . | |
| 4,354,598 | 10/1982 | Schillinger . | |
| 4,549,654 | 10/1985 | Tiesman . | |
| 4,591,090 | 5/1986 | Collins et al. | 229/120.36 |
| 4,915,224 | 4/1990 | Wulf et al. . | |
| 5,011,011 | 4/1991 | Kidd | 206/319 |
| 5,048,677 | 9/1991 | Pedracine . | |
| 5,114,002 | 5/1992 | Warner . | |
| 5,323,911 | 6/1994 | Johnston et al. | 206/526 |
| 5,332,085 | 7/1994 | Fraser | 206/526 |
| 5,495,937 | 3/1996 | Fraser | 206/320 |

*Primary Examiner*—Jimmy G. Foster
*Attorney, Agent, or Firm*—Brooks & Kushman P.C.

[57] ABSTRACT

A shipping and retail display pallet pack having a base adapted to receive one end of the articles to be shipped and displayed mounted on a pallet. The base has a formed seat for each article to be shipped and displayed and retainer walls dividing the interior of the base into a compartment for each article. A top retainer, vertically separated from the base, has a plurality of cavities which enclose the ends of the articles opposite the base. For shipping side panels enclose the pallet pack between the base and the top retainer and a cover is disposed of the top retainer. Horizontal strapping secures the side panels to the base and the top retainer and vertical strapping secures the cover on top of the top retainer and the remainder of the pallet pack to a shipping pallet.

19 Claims, 6 Drawing Sheets

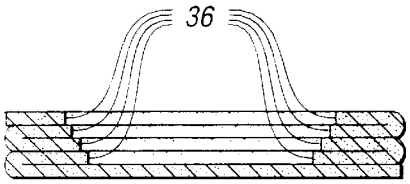
Fig. 6
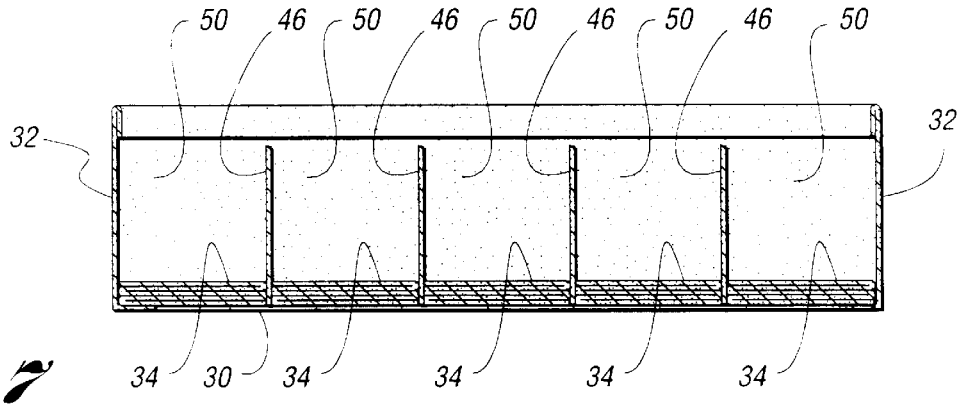
Fig. 7
Fig. 8
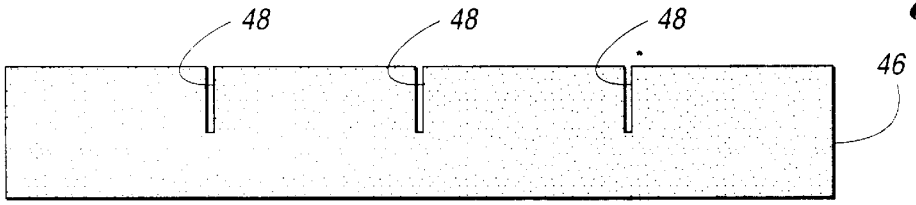
Fig. 9
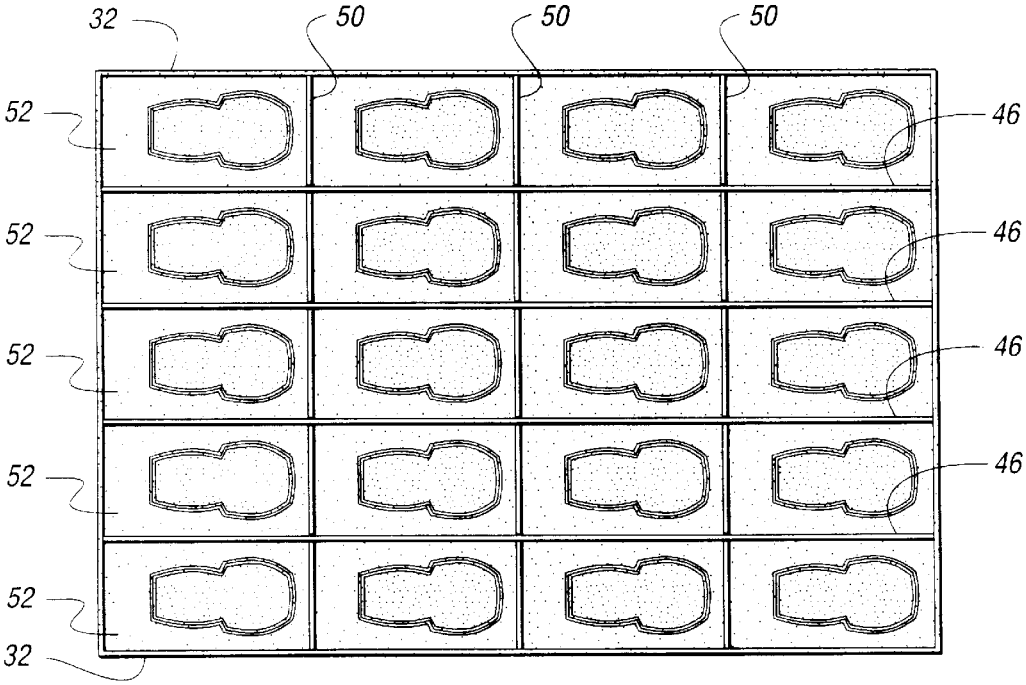

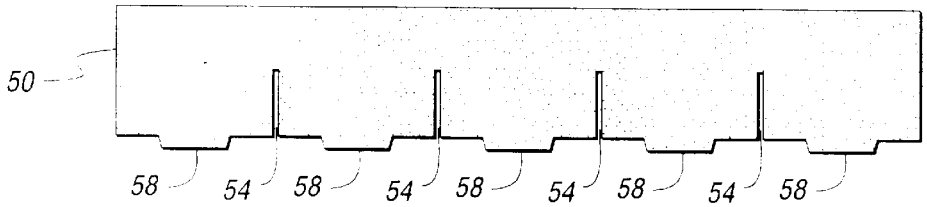
Fig. 10
Fig. 11
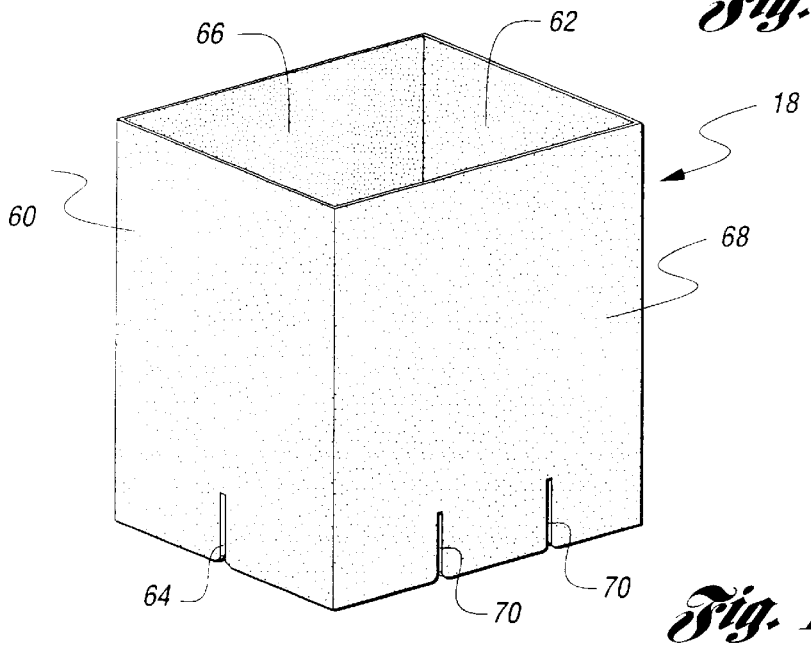
Fig. 12
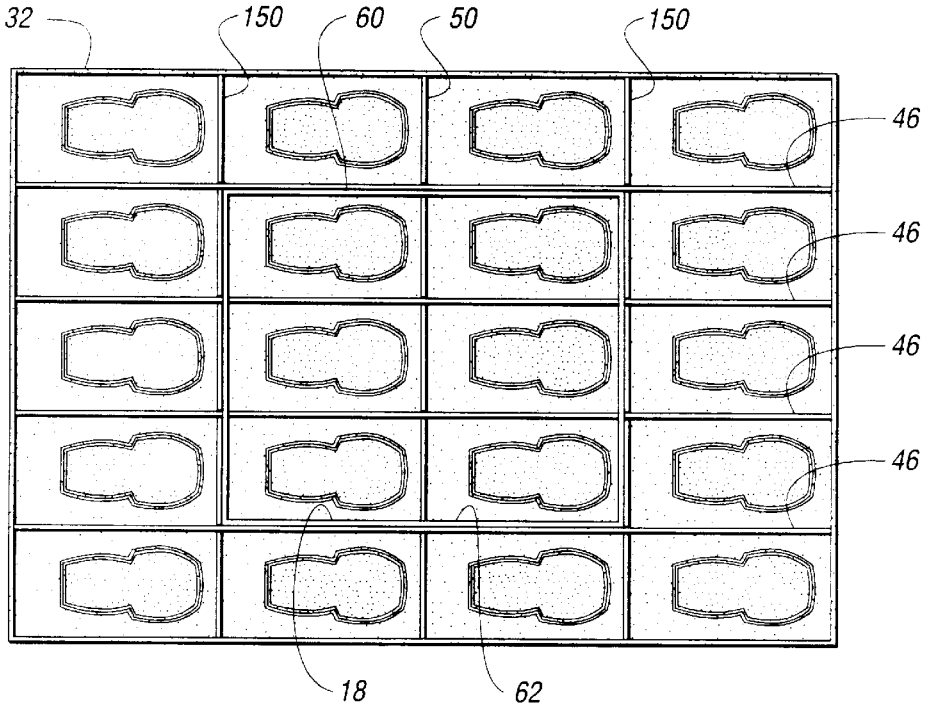

SHIPPING AND RETAIL DISPLAY PALLET PACK

TECHNICAL FIELD

The present invention relates to shipping and display cartons for lawn, garden, and similar implements and, in particular, to a shipping and retail display for gasoline string trimmers mounted on a conventional type pallet.

BACKGROUND ART

Outdoor tools such as lawn and garden implements are designed to be comfortable in the hands of the operator. The desirability and comfort of the implement is often a key factor in determining whether or not a consumer will purchase the product. Therefore, it is important that the consumer may be able to physically grip, hold, or otherwise manipulate the product in his or her hands at the point of sale.

Traditionally, such products are enclosed in cardboard boxes or containers and the product itself is not ready available to the consumer. Either the consumer must rely on the pictures and literature on the sides of the boxes or the retailer make available to the potential consumer, an unboxed product for display and handling purposes. The continuous handling of a displayed product by a parade of potential customers often results in physical damage to the displayed product and the theft of removable components. Often, the damage is sufficient to result in a "return to vendor" situation or sold at a substantial loss to the retailer.

In addition to the inability of the potential customer to touch and hold the product without opening the packaging, such conventional packaging often added weight and bulkiness to the product making it awkward to carry the product from the display to the cashier and from the cashier to the consumer's final destination. Further, the individual packaging of each item adds to the product's cost.

Another factor which has caused problems is the movement of the product from a receiving dock to a storage area, the subsequent movement of the product from the storage area to the display area and final physical act of placing the product on the display shelves. These are labor intense operations which add to the cost of the product and often does not result in an attractive display and one which makes the product readily available to the potential customers.

The present invention is directed to improving known shipping and display containers for garden and lawn implements, household items or other similar items.

SUMMARY OF THE INVENTION

The invention is a shipping and retail display pallet pack for articles to be shipped and retailed. The shipping and display pallet pack has a base sized to fit on a shipping pallet. The base has a bottom and side walls defining an interior region. At least one lower support member is disposed in the interior of the base adjacent to the bottom thereof. The lower support member has a plurality of formed seats for retaining one end of each article to be shipped and displayed. A plurality of separators are disposed in the base to divide the interior thereof into a plurality of compartments, each compartment being associated with a respective one of the formed seats. A top retainer vertically separated from the base has a plurality of retainer cavities equal in number to the number of formed seats in the lower support member, each retainer cavity engageable with a respective one of the ends of each article opposite the end received in the lower support member.

For shipping purposes, side panels are provided between the base and the upper edge of the top retainer to enclose the articles, and a cover is provided enclosing the upper surface of the top retainer and securing the top edges of panels to the top retainer. At least one horizontal shipping strap is used to secure the side panels to the base and at least one vertical strap is used to secure the enclosed shipping pack to the pallet.

One object of the invention is to provide a shipping and display pallet pack which includes its own shipping pallet.

Another object of the invention is that the display case is enclosed by removable panels and a cover for shipping purposes.

A further object of the invention is that the display is ready for retail sales upon the removal of the side panels and the cover.

Still another object of the invention is that each article being displayed is contained within separate compartments of the base of the display.

Yet another object of the invention is that a formed seat for one end of each article is provided in each compartment.

Another object is the use of a top retainer to support and separate the ends of the articles opposite the ends received in the compartments of the base in individual cavities.

A final object of the invention is a display from which the articles can be readily removed by a potential buyer to physically hold and obtain a feel for the article.

These and other objects will become more apparent from a reading of the specification in conjunction with the drawings.

BRIEF DESCRIPTION OF THE DRAWINGS

FIG. 6 is a cross-sectional view of the base support preform taken along section lines 6—6 of FIG. 5;

FIG. 7 is a cross-sectional front view of the base;

FIG. 8 is a side view of the longitudinal separator;

FIG. 9 is a top view of the base;

FIG. 10 is a side view of a transverse separator;

FIG. 11 is a perspective of the separator box;

FIG. 12 is a top view showing the location of the side walls of the separator box in the base;

DETAILED DESCRIPTION OF THE PREFERRED EMBODIMENTS

Figure 1:
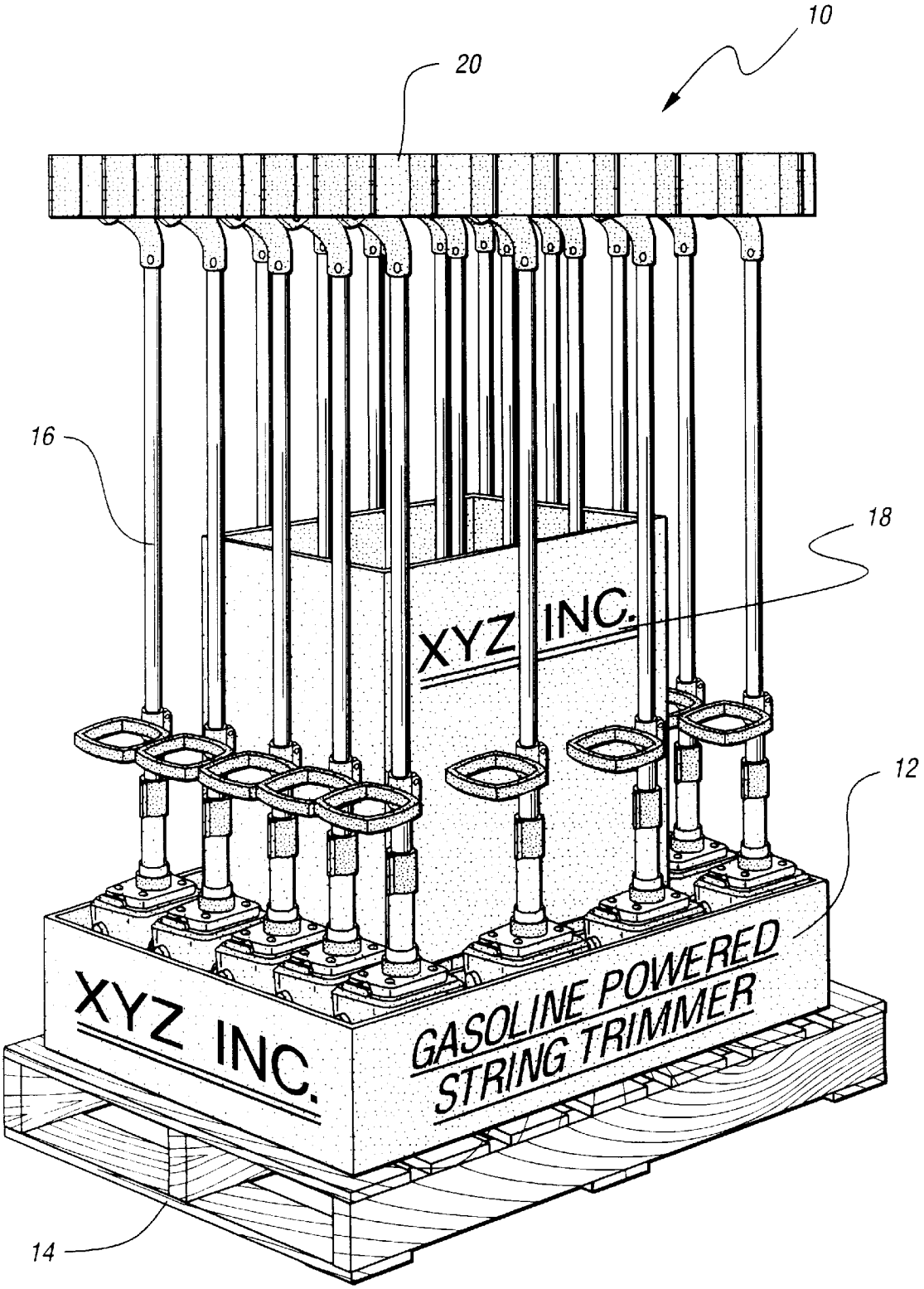
FIG. 1 is a perspective of the shipping and display pallet pack absent the shipping panels and cover.

The details of the display case 10 of the pallet pack shipping and retail display are shown in FIG. 1. The display case 10 has a generally rectangular base 12 which can readily be supported on a shipping pallet 14 for shipment. A plurality of articles to be displayed for retail such as gas-powered string trimmers 16 are vertically supported by the base 12. In the preferred embodiment, six gas-powered string trimmers 16 are supported within a separator box 18 and fourteen string trimmers are symmetrically supported external to the separator box. However, it is to be noted that the display case 10 is not limited to shipping and displaying string trimmers or is the number of articles limited to twenty items.

The gasoline-powered string trimmers 16 are mounted with gas engines contained within the base 12 and the rotary cutting head extending upwardly therefrom. The rotary cutting head of each string trimmer 16 is individually captured by a top retainer 20 which holds the cutting mechanism ends in a spaced relationship relative to each other which corresponds to the spaced relationship of the gas engines as they are supported in the base 12.

Figure 2:
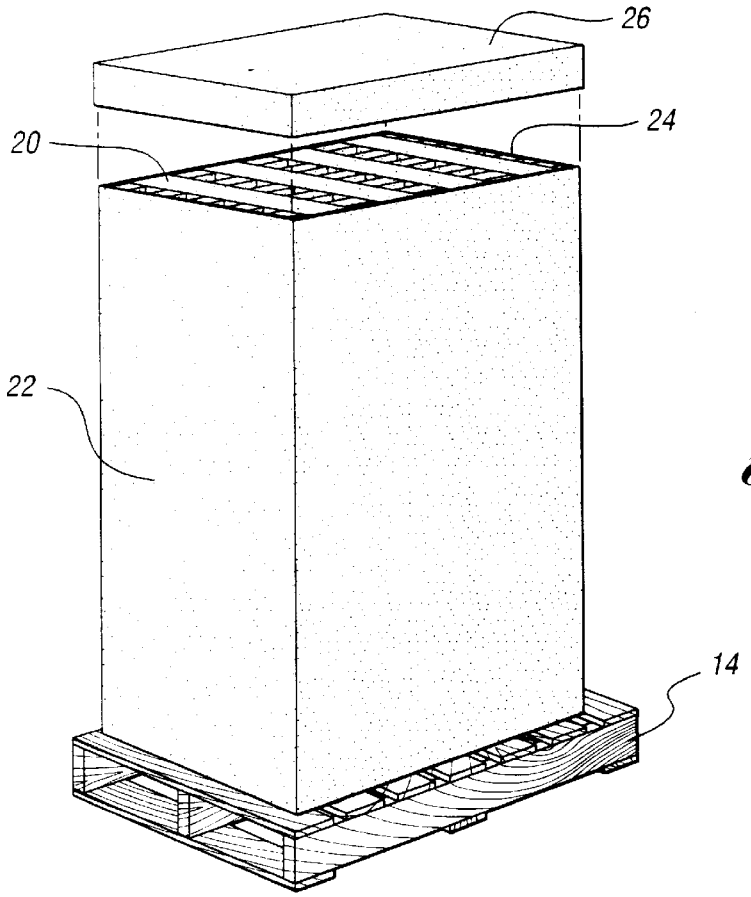
FIG. 2 is a perspective of the shipping and display pallet pack with the side panels and cover in place.
Figure 3:
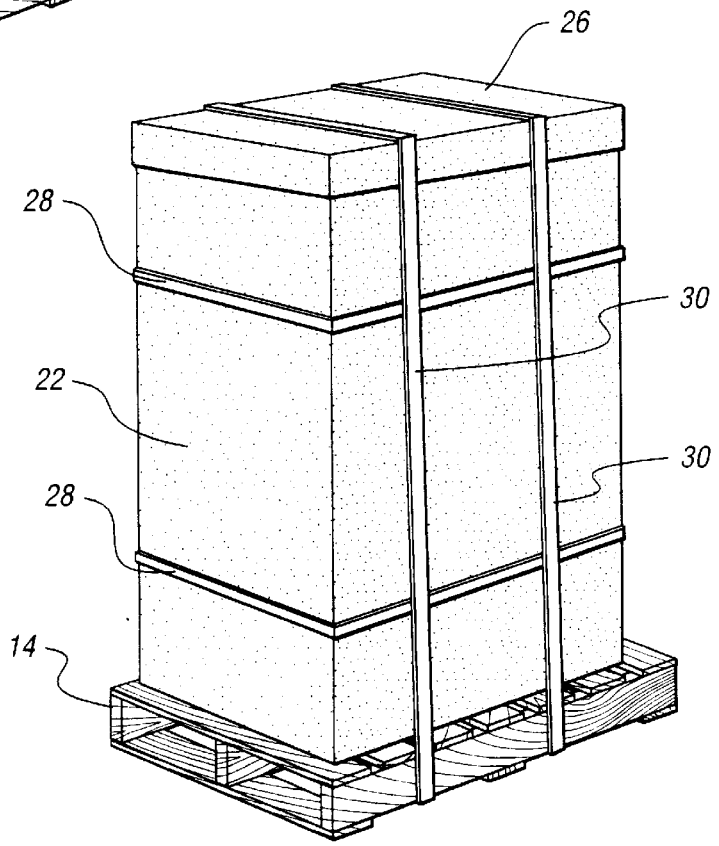
FIG. 3 is a perspective of the shipping and display pallet pack sealed for shipping.

As shown in FIG. 2, side shipping panels 22 and 24 enclose the space between the top retainer 20 and the base 12 on all four sides and a shipping cover 26 is placed over the top retainer 20 for shipping purposes. The side walls of the cover 26 extend over the shipping panels 22 and 24 and secure them in place at their upper ends. After the shipping cover 26 is positioned in place over the side shipping panels, horizontal strapping 28 may be affixed to the pallet shipping pack 8 to secure the shipping panels 22 and 24 to the base 12 and to the top retainer 20 as shown in FIG. 3. Further vertical strapping 30 is used to secure the pallet shipping pack 8 to the pallet 14.

In the preferred embodiment, the side shipping panels 22 and 24 and the shipping cover 26 are made from corrugated cardboard or any equivalent shipping material.

At the retail destination, the strapping 28 and 30, the cover 26, and the shipping panels 22 and 24 are removed, exposing the articles to be retailed in the display case 10 as shown in FIG. 1. The articles to be retailed remain supported by the base 12 and top retainer 20. The side walls of the base 12 and the separator box 18 may be decorated with product identification as well as the manufacturer's name, as shown in FIG. 1, to enhance the attractiveness of the display.

Figure 4:
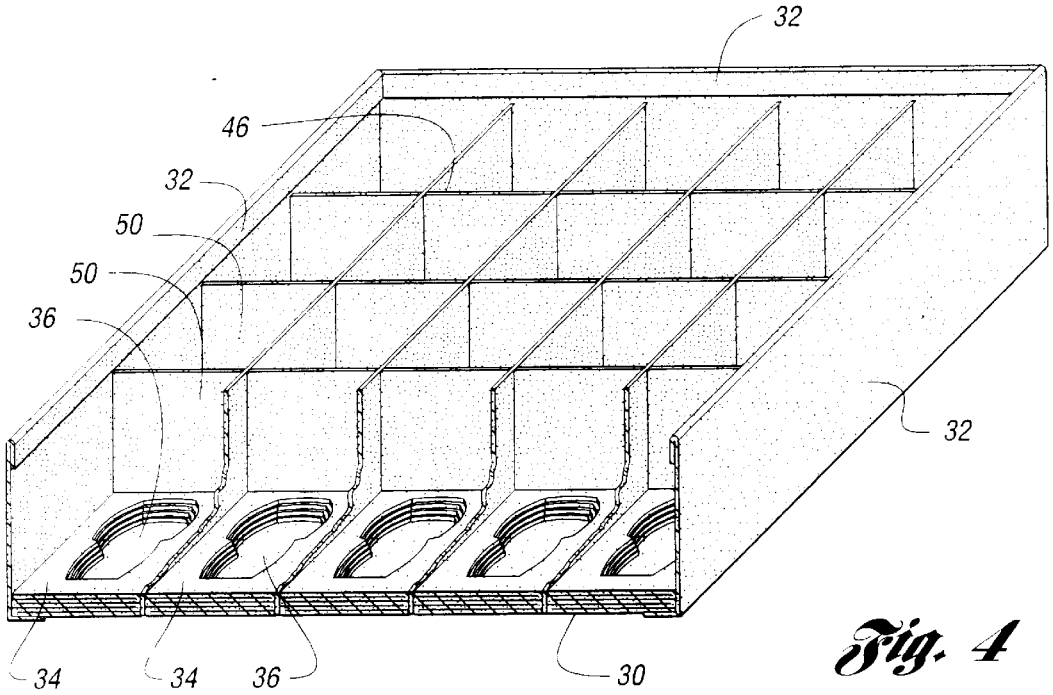
FIG. 4 is a perspective showing the details of the base.

The details of the base 12 are shown in FIG. 4. The base 12 consists of a rectangular cardboard box having a bottom 30 and four vertical side walls 32. A series of lower support members 34 are received in the bottom of base 12. Each lower support element 34 has a plurality of seats 36 contoured to mate with and individually support the gasoline engine of string trimmers 10.

Figure 5:
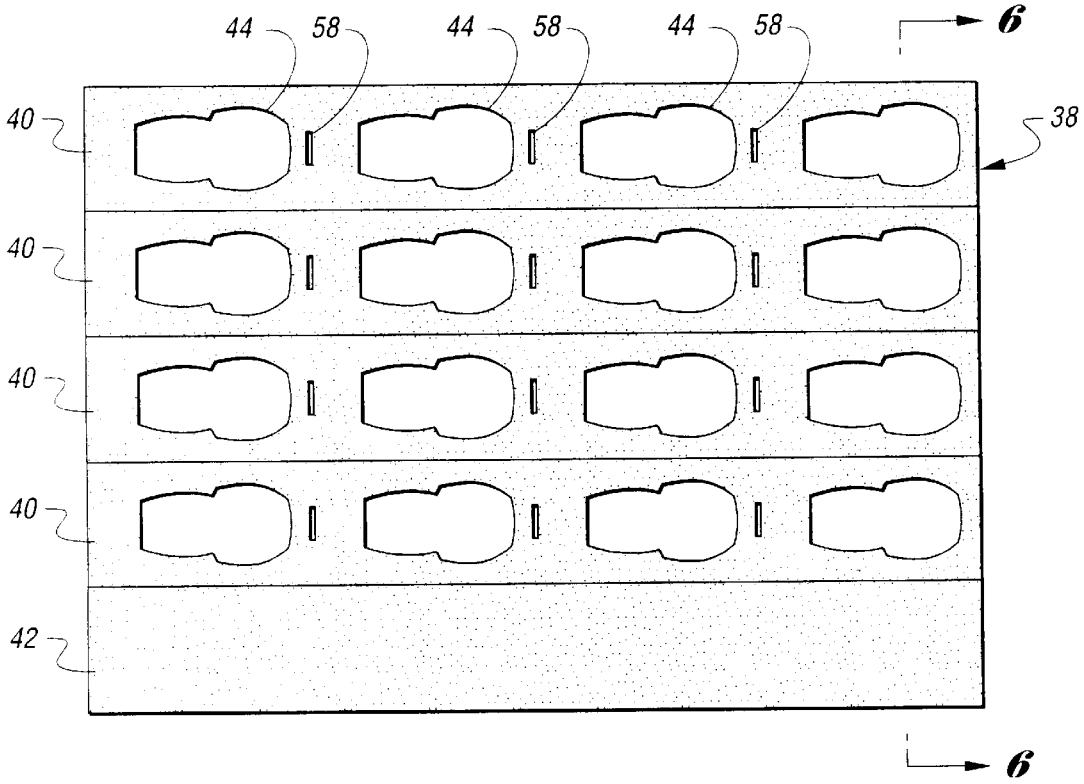
FIG. 5 is a plan view of the base support preform.

Each lower support member 34 is a foldable preform 38, as shown in FIG. 5, having a selected number of leafs 40. With the exception of the bottom leaf 42, each leaf has a cut-out 44 which mates with the corresponding cut-outs 44 in the adjacent leaf. The size of the mating cut-outs 38 may be selected to be slightly different from each other to form the contoured seats 36 for the gasoline engine of the string trimmer when the leafs 40 are folded in an accordion style as shown in FIG. 6. The folded cover support members 34 may be longitudinally disposed in parallel across the bottom 30 of the base 12. Alternatively, the lower support member may consist of a series of individual flat preformed members (not shown) stacked on top of each other to form the desired plurality of seats.

A first longitudinal set of separators 46 are inserted between adjacent lower support members 34. The longitudinal separators 46, as shown in FIG. 8, have a plurality of upwardly extending vertical slots 48 provided part way across the width of each longitudinal separator 46. A set of transverse separators 50, shown in FIG. 9, are disposed in the slots 48 of the longitudinal separator 46 to form a plurality of rectangular compartments 52 in the base 12, as shown in FIG. 8. Each transverse separator 50 may have a plurality of downwardly extending slots 54 which straddle the unslotted portions of the transverse separators 46. The depth of the slots 48 and 54 are selected such that the tops of the longitudinal and transverse separators are coplanar and extend vertically substantially to the same height from the bottom 30 of the base 12.

The transverse separators 50 preferably include a set of equally spaced tabs 56, as shown in FIG. 9, which are received in rectangular slots 58 provided in the preform 38 of the lower support members 34, as shown in FIG. 5 when the transverse separators 50 are fully inserted into the slots 48 of longitudinal separators 48. The insertion of the tabs 56 into the slots 58 help stabilize the transverse separators 46 relative to the lower support members 34.

The details of the separator box 18 are shown in FIG. 10. The separator box 18 has a generally rectangular shape having four sides dimensioned to be received in the base 32 to isolate the six string trimmers in the central region of the base from the twelve string trimmers disposed in the base 32 about the periphery of the separator box 18. The longitudinal sides 60 and 62 of the separator box 18 have a single slot 64 adapted to receive the transverse separators 50 and the transverse sides 66 and 68 have two slots 70 adapted to receive therein the longitudinal separators 46 As shown in FIG. 11, the longitudinal sides 60 and 62 of the separator box 18 are disposed inside of and adjacent to the two outermost separators 46 identified in FIG. 11 by the reference numerals 146 and the transverse sides 66 and 68 of the separator box are disposed inside of and adjacent to the two outermost transverse separators 50 identified in FIG. 11 by the reference numerals 150. The two centermost longitudinal separators 46 are received in slots 70 and the center transverse separator 50 is received in the slots 64. As shown in FIG. 10, the bottom edges of the slots 64 and 70 are flared outwardly to facilitate the insertion of the separator box 18 in the base 32 and to seat the lower edge of the separator box 18 on the upper surfaces of the lower support members 34. In the preferred embodiment, the separator box 18 is made from corrugated cardboard and has a height substantially greater than the height of the walls 32 of the base 12. In the preferred embodiment, as illustrated in FIG. 1, the top end of the separator box 18 is approximately halfway between the base 12 and the top retainer 20.

Figure 13:
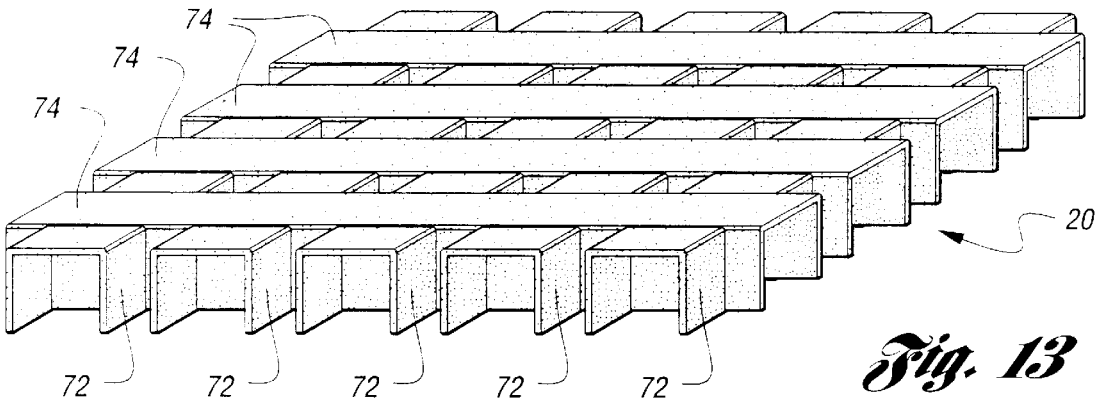
FIG. 13 is a perspective of the top retainer.
Figure 14:
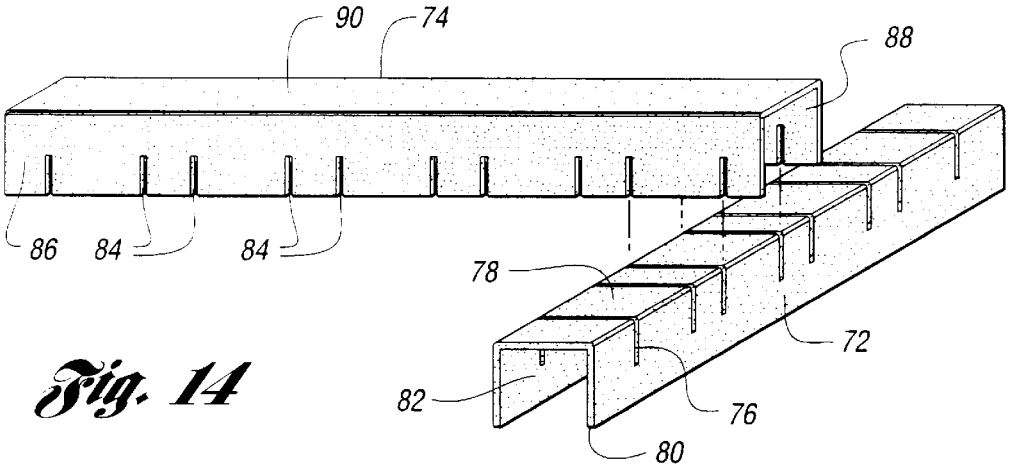
FIG. 14 is an exploded view showing the insertion of the transverse member of the top retainer into the longitudinal member.
Figure 15:
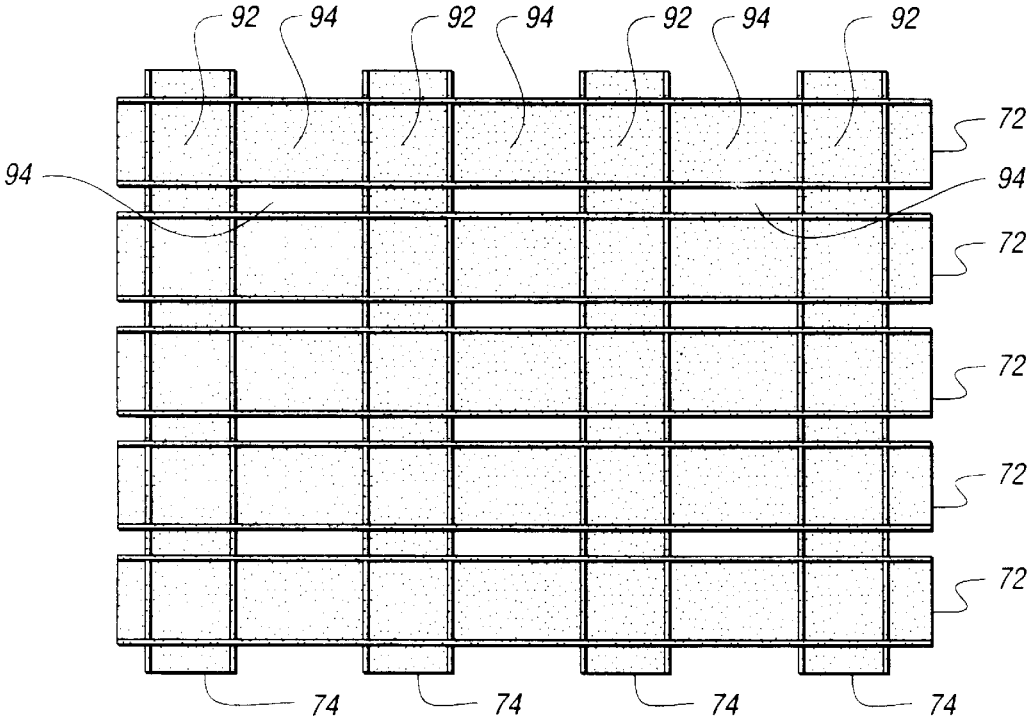
FIG. 15 is a bottom view of the top retainer.

The details of the top retainer 20 are shown in FIGS. 12, 13 and 14. The top retainer 20 comprises a plurality of longitudinal members 72 corresponding in number to the number of base support members 34 disposed in the base 12 and a plurality of transverse members 74 corresponding in number to the number of seats 36 provided in each of the support members 34. The longitudinal members 72 have an inverted "U" shape and have a series of slots 76 which are provided across the top 78 and extend partway down the sides 80 and 82. The slots 76 are arranged along the length of longitudinal member 72 to support the transverse members 74 in a spaced relationship, as shown in FIG. 12.

The transverse members 74 have a series of downwardly extending slots 84 which mate with slots 76 provided in the longitudinal members 72. The depth of the slots 76 and 84 is selected so that the side walls 86 and 88 are fully received in the slots 76. When the side walls 86 and 88 are fully received in the slots 76, the internal surfaces of the top 90 of the transverse members 74 rests on the external surfaces of the top 78 of the longitudinal member 72. As would be obvious to one skilled in the art, the arrangement of the slots 76 and 84 may be reversed so that the internal surface of top 78 rests on the external surface 90 of the transverse member 74.

FIG. 14 is a bottom view of the top retainer 20 showing the array of retainer cavities 92 formed by the insertion of the transverse members 74 in the slots 76 of the longitudinal members. Each retainer cavity 92 supports a respective one of the rotary heads of the string trimmers and is separated from each adjacent retainer cavity 92 by a space 94 between the walls of the longitudinal and transverse elements 72 and 74, respectively.

While the best mode for carrying out the invention has been described in detail, those familiar with the art to which this invention relates will recognize various alternative designs and embodiments for practicing the invention as defined by the following claims.

What is claimed is:

1. A pallet pack shipping and retail display arrangement comprising:

a base sized to fit on a shipping pallet, said base having a bottom and side walls defining an interior;

a plurality of elongate motorized implements, each having a lower and upper portion, the lower portions of the implements removably retained in the interior of the base;

a top retainer vertically separated from and held above the base solely by engagement with the upper portions of at least some of the implements so to form a predetermined array of the implements extending upwardly from the base during shipment and display.

2. The arraignment of claim 1 further comprising:

side panels for enclosing the implements between the base and top retainer during shipment;

a cover disposed over the top retainer, the cover having side walls captivating the top retainer; and strapping to secure the side panels to the base and the top retainer and the cover and top retainer to the shipping pallet.

3. A pallet pack shipping and retail display for a plurality of articles to be shipped and retailed, comprising:

a base sized to fit on a shipping pallet, said base having a bottom and side walls defining an interior;

at least one lower support member disposed in the interior of said base, said lower support member having a plurality of seats for retaining one end of each article to be shipped and displayed;

a plurality of separators disposed in said base dividing the interior thereof into a plurality of compartments, each compartment of said plurality of compartments being associated with a respective one of said plurality of seats;

a top retainer vertically separated from said base, said top retainer having a plurality of retainer cavities equal in number to the number of seats in said lower support member, each retainer cavity engageable with a respective one of the ends of said articles opposite said one end;

at least one lower support member is a plurality of lower support members disposed parallel to each other across said bottom of said base, each lower support member of said plurality of lower support members having a predetermined number of said seats; and wherein each lower support member comprises a folded preform, said preform having plural leafs, each leaf having a number of cut outs equal to the predetermined number of seats which align with each other when the leafs are folded against each other.

4. The pallet pack of claim 3 wherein said cut-outs are omitted from the leaf of said folded preform adjacent to the bottom of said base.

5. The pallet pack of claim 3 wherein the shape of said cut-outs on adjacent leafs of said preform are selected to provide a contoured seat mating with the shape of the end of the article received in said seat.

6. A pallet pack shipping and retail display for articles to be shipped and retailed, comprising:

a base sized to fit on a shipping pallet, said base having a bottom and side walls defining an interior;

at least one lower support member disposed in the interior of said base, said lower support member having a plurality of seats for retaining one end of each article to be shipped and displayed;

a plurality of separators disposed in said base dividing the interior thereof into a plurality of compartments, each compartment of said plurality of compartments being associated with a respective one of said plurality of seats;

a top retainer vertically separated from said base, said top retainer having a plurality of retainer cavities equal in number to the number of seats in said lower support member, each retainer cavity engageable with a respective one of the ends of said articles opposite said one end;

at least one lower support member is a plurality of lower support members disposed parallel to each other across said bottom of said base, each lower support member of said plurality of lower support members having a predetermined number of said seats;

said lower support members are disposed parallel to each other in a longitudinal direction, said plurality of separators comprises:

a longitudinal set of separators disposed between adjacent one of said lower support members;

a transverse set of separators disposed normal to said longitudinal set of separators;

said longitudinal set of separators has a first plurality of slots for receiving said transverse separators therein;

said transverse set of separators has a second plurality of slots for receiving said longitudinal separators therein;

said first and second sets of slots have a vertical depth selected such that the top edges of said longitudinal set of separators are substantially coplanar with the top edges of said transverse set of separators;

each separator of said transverse set of separators has tabs provided along its lower edge intermediate said second set of slots and wherein each of said support members has slots for receiving said tabs therein.

7. A pallet pack shipping and retail display for articles to be shipped and retailed, comprising:

a base sized to fit on a shipping pallet, said base having a bottom and side walls defining an interior;

at least one lower support member disposed in the interior of said base, said lower support member having a plurality of seats for retaining one end of each article to be shipped and displayed;

a plurality of separators disposed in said base dividing the interior thereof into a plurality of compartments, each compartment of said plurality of compartments being associated with a respective one of said plurality of seats;

a top retainer vertically separated from said base, said top retainer having a plurality of retainer cavities equal in number to the number of seats in said lower support member, each retainer cavity engageable with a respective one of the ends of said articles opposite said one end;

said plurality of compartments includes at least one interior compartment surrounded by a predetermined number of exterior compartments, said pallet pack further including a separator box separating said at least one interior compartment from said predetermined number of exterior compartments, said separator box having a height intermediate the distance said top retainer is separated from said base.

8. The pallet pack of claim 7 wherein said pallet pack has six interior compartments and fourteen exterior compartments, said separator box separates said six interior compartments from said fourteen external compartments.

9. The pallet pack of claim 8 wherein said separator box is received in said base inside of and adjacent to the separator of said plurality of separators separating said internal compartment from said external compartments, the walls of said separator box including slots for receiving the separator extending across the interior of said separator box to permit the lower edge of said separator box to engage the upper surface of said at least one lower support member.

10. A pallet pack shipping and retail display for articles to be shipped and retailed, comprising:

a base sized to fit on a shipping pallet, said base having a bottom and side walls defining an interior;

at least one lower support member disposed in the interior of said base, said lower support member having a plurality of seats for retaining one end of each article to be shipped and displayed;

a plurality of separators disposed in said base dividing the interior thereof into a plurality of compartments, each compartment of said plurality of compartments being associated with a respective one of said plurality of seats;

a top retainer vertically separated from said base, said top retainer having a plurality of retainer cavities equal in number to the number of seats in said lower support member, each retainer cavity engageable with a respective one of the ends of said articles opposite said one end; and said top retainer comprising a set of inverted U-shaped longitudinal members and a set of inverted "U" shaped transverse members disposed transverse to said longitudinal members, at least one of said longitudinal and transverse members having slots provided thereon to receive the other of said longitudinal and transverse members thereacross to form said plurality of retainer cavities.

11. The pallet pack of claim 10 wherein each of said inverted U-shaped longitudinal and transverse member have a top and two downwardly descending sides provided along opposite sides of said top, one of said longitudinal and transverse members have a first set of slots, each slot of said first set of slots being provided through said top and extending downwardly part way across said side walls, and the other of said longitudinal and transverse members having a second set of mating upwardly extending slots along each side such that the other of said longitudinal and transverse member may be fully inserted into the one of said longitudinal and transverse members.

12. The pallet pack of claim 10 wherein the locations of said first and second set of slots are selected to separate adjacent longitudinal and adjacent transverse members a predetermined distance from each other.

13. A pallet pack shipping and retail display for a plurality of string trimmers to be shipped and retailed, each trimmer having a rotary trimmer head, comprising:

a base sized to fit on a shipping pallet, said base having a bottom and side walls defining an interior;

at least one lower support member disposed in the interior of said base, said lower support member having a plurality of seats for retaining the string trimmer to be shipped and displayed;

a plurality of separators disposed in said base dividing the interior thereof into a plurality of compartments, each compartment of said plurality of compartments being associated with a respective one of said plurality of seats;

a top retainer vertically separated from said base, said top retainer having a plurality of retainer cavities equal in number to the number of seats in said lower support member, each retainer cavity engageable with a respective one of said string trimmers;

said at least one lower support member is a plurality of lower support members disposed parallel to each other across said bottom of said base, each lower support member of said plurality of lower support members having a predetermined number of said seats;

said lower support members are disposed parallel to each other in a longitudinal direction, said plurality of separators comprises:

a longitudinal set of separators disposed between adjacent one of said lower support members;

a transverse set of separators disposed normal to said longitudinal set of separators;

said longitudinal set of separators has a first plurality of slots for receiving said transverse separators therein;

said transverse set of separators has a second plurality of slots for receiving said longitudinal separators therein;

said first and second sets of slots have a vertical depth selected such that the top edges of said longitudinal set of separators are substantially coplanar with the top edges of said transverse set of separators; and each separator of said transverse set of separators has tabs provided along its lower edge intermediate said second set of slots and wherein each of said support members has slots for receiving said tabs therein.

14. A pallet pack shipping and retail display for a plurality of string trimmers to be shipped and retailed, each trimmer having a rotary trimmer head, comprising:

a base sized to fit on a shipping pallet, said base having a bottom and side walls defining an interior;

at least one lower support member disposed in the interior of said base, said lower support member having a plurality of seats for retaining the string trimmer to be shipped and displayed;

a plurality of separators disposed in said base dividing the interior thereof into a plurality of compartments, each compartment of said plurality of compartments being associated with a respective one of said plurality of seats;

a top retainer vertically separated from said base, said top retainer having a plurality of retainer cavities equal in number to the number of seats in said lower support member, each retainer cavity engageable with a respective one of said string trimmers; and said plurality of compartment includes at least one interior compartment surrounded by a predetermined number of exterior compartments, said pallet pack further including a separator box separating said at least one interior compartment from said predetermined number of exterior compartments, said separator box having a height intermediate the distance said top retainer is separated from said base.

15. The pallet pack of claim 14 wherein said pallet pack has six interior compartments and fourteen exterior compartments, said separator box separates said six interior compartments from said fourteen external compartments.

16. The pallet pack of claim 15 wherein said separator box is received in said base inside of and adjacent to the separator of said plurality of separators separating said internal compartment from said external compartments, the walls of said separator box including slots for receiving the separator extending across the interior of said separator box to permit the lower edge of said separator box to engage the upper surface of said at least one lower support member.

17. A pallet pack shipping and retail display for gas-powered string trimmers having a gasoline engine provided at one end and a rotary trimmer head provided at the opposite end to be shipped and retailed, comprising:

a base sized to fit on a shipping pallet, said base having a bottom and side walls defining an interior;

at least one lower support member disposed in the interior of said base, said lower support member having a plurality of seats for retaining the gasoline engine of each string trimmer to be shipped and displayed;

a plurality of separators disposed in said base dividing the interior thereof into a plurality of compartments, each compartment of said plurality of compartments being associated with a respective one of said plurality of seats;

a top retainer vertically separated from said base, said top retainer having a plurality of retainer cavities equal in number to the number of seats in said lower support member, each retainer cavity engageable with a respective one of the rotary trimmer head of said string trimmers; and said top retainer comprising a set of inverted U-shaped longitudinal members and a set of inverted "U" shaped transverse members disposed transverse to said longitudinal members, at least one of said longitudinal and transverse members having slots provided thereon to receive the other of said longitudinal and transverse members thereacross to form said plurality of retainer cavities.

18. The pallet pack of claim 17 wherein each of said inverted U-shaped longitudinal and transverse member have a top and two downwardly descending sides provided along opposite sides of said top, one of said longitudinal and transverse members have a first set of slots, each slot of said first set of slots being provided through said top and extending downwardly part way across said side walls, and the other of said longitudinal and transverse members having a second set of mating upwardly extending slots along each side such that the other of said longitudinal and transverse member may be fully inserted into the one of said longitudinal and transverse members.

19. The pallet pack of claim 17 wherein the locations of said first and second set of slots are selected to separate adjacent longitudinal and adjacent transverse members a predetermined distance from each other.

* * * * *